US012760468B2

(12) United States Patent
Fei et al.

(10) Patent No.: US 12,760,468 B2
(45) Date of Patent: Oct. 13, 2026

(54) CONTINUOUS TEXTILE FABRIC, INTEGRATED PROCESSING EQUIPMENT AND PREPARATION METHOD

(71) Applicant: Ningbo Xinrun Textile Co., Ltd., Ningbo (CN)

(72) Inventors: Chenxin Fei, Ningbo (CN); Lijun Lin, Ningbo (CN); Jieyuan Cen, Ningbo (CN); Buyi Cen, Ningbo (CN)

(73) Assignee: Ningbo Xinrun Textile Co., Ltd., Ningbo (CN)

( * ) Notice: Subject to any disclaimer, the term of this patent is extended or adjusted under 35 U.S.C. 154(b) by 308 days.

(21) Appl. No.: 18/747,607

(22) Filed: Jun. 19, 2024

(65) Prior Publication Data

US 2025/0327243 A1 Oct. 23, 2025

(30) Foreign Application Priority Data

Apr. 18, 2024 (CN) ..... 202410467791.2

(51) Int. Cl.
*D06P 5/24* (2006.01)
*D06P 7/00* (2006.01)

(52) U.S. Cl.
CPC ..... *D06P 5/003* (2013.01); *D06P 7/00* (2013.01); *D10B 2403/0111* (2013.01)

(58) Field of Classification Search
CPC ..... D06H 7/22; D06H 7/221; D06H 7/223; D06H 7/225; D06P 5/00; D06P 5/003; D06P 7/00
See application file for complete search history.

(56) References Cited

U.S. PATENT DOCUMENTS

2020/0054156 A1* 2/2020 Chang ..... A47G 23/0303

FOREIGN PATENT DOCUMENTS

| | | | | |
|---|---|---|---|---|
| CN | 213949400 U | | 8/2021 | |
| CN | 215899507 U | | 2/2022 | |
| CN | 114714730 A | * | 7/2022 | ..... B32B 5/02 |
| CN | 217398035 U | | 9/2022 | |

OTHER PUBLICATIONS

CN 114714730 Machine Translation (Year: 2022).*

* cited by examiner

*Primary Examiner* — Zachary M Davis
(74) *Attorney, Agent, or Firm* — JEEN IP LAW, LLC

(57) ABSTRACT

A continuous textile fabric, an integrated processing equipment, and a preparation method are provided, the integrated processing equipment for continuous textile fabric includes a feeding fabric mechanism, a receiving fabric mechanism, a heat transfer printing mechanism, and a hot melt mechanism; the heat transfer printing mechanism includes a transfer worktable, a second driving component, a hot press plate, a transfer feeding material component, and a transfer receiving material component; the transfer printing workbench includes a work plane configured for laying locally continuous towel cloth; a second section of the continuous towel cloth passes through the hot melt mechanism; during a pause time of conveying the continuous towel cloth, the hot press plate is driven and pressed by the second driving component, pattern on the heat transfer paper below it is transferred to an upper surface of a first position.

13 Claims, 11 Drawing Sheets

CONTINUOUS TEXTILE FABRIC, INTEGRATED PROCESSING EQUIPMENT AND PREPARATION METHOD

CROSS-REFERENCE TO RELATED APPLICATIONS

This application claims priority to Chinese Patent Application No. 202410467791.2, filed on Apr. 18, 2024, which is hereby incorporated by reference in its entirety.

TECHNICAL FIELD

The present disclosure relates to the field of textile fabric processing technologies, and in particular, to a continuous textile fabric, an integrated processing equipment, and a preparation method for synchronously preparing heat transfer patterns and hot melt tear lines on the continuous textile fabric with loops or fuzz. Pattern information includes a trademark, an icon, a care label, a symbol, and instruction and precaution.

BACKGROUND

As an essential item for daily face washing and bathing, household towels are made of cotton that provides better comfort to human skin. They have excellent workmanship and durability and can be used for at least a few months under a normal circumstance. The manufacturer will add a fabric label on the towel, which will print a trademark, an ingredient, and an instruction indicating the source of the product.

There are disposable tear-off towels on the market, such as a disposable tear-off towel roll disclosed in CN215899507U. Of course, it can also be used multiple times, mainly used for cleaning vehicles, floors, kitchens, bathrooms, etc.; compared to household towels, the material is mainly fiber, which is thinner in thickness and cheaper in price. However, there are also cases of tearing and drawing.

Due to its short use time, disposable towels are packaged in a form similar to napkins, such as a pull-out folding cloth displayed in CN213949400U, and a portable tear-off towel in CN217398035U. The manufacturer prints the trademark and instruction on a paper box or a plastic bag, but there is no product related information on the tear-off towel.

With the increasing emphasis on brand awareness, entrepreneurs hope to print product information on the disposable towel, thereby increasing visibility of relevant information about the product for a user.

At present, in the market, the existing technology for producing ultra-fine fiber printed fabrics often uses hot roller pressing, which will inevitably press down loops on the two surfaces of the ultra-fine fiber fabric, resulting in a loss of soft and fluffy feeling of the lop on two surfaces of the ultra-fine fiber towel. There is no processing equipment that can achieve synchronous processing of hot melt tear lines and patterns. When using the method of printing patterns first and then preparing the hot melt tear line, the two processes require a lot of manpower and time. Moreover, when making the hot melt tear line later, because it is not produced synchronously, a position of pattern on a single piece of polyester textile fabric after heat transfer printing is prone to change, rendering it difficult to control product quality and thus not meeting requirements for mass production of tear-off ultra-fine fiber heat transfer printed towels.

SUMMARY

The technical problem to be solved by the present disclosure is to provide a continuous textile fabric with patterns and hot melt tear lines, an integrated processing equipment for continuous textile fabric capable of synchronously preparing patterns and hot melt tear lines, and a specific preparation method thereof, so as to synchronously prepare heat transfer patterns and hot melt tear lines on the continuous textile fabric with loops or fuzz. Pattern information includes a trademark, an icon, a care label, a symbol, and an instruction and a precaution. In this way, even if each fabric unit is separated from an entire roll, relevant product information of the textile fabric can still be clearly obtained.

In an embodiment of the present disclosure: an integrated processing equipment for continuous textile fabric, including:

a feeding fabric mechanism and a receiving fabric mechanism configured to convey the continuous textile fabric along a length direction and stop at work cycle intervals, and a heat transfer printing mechanism and a hot melt mechanism respectively provided at two positions in a conveying direction of the continuous textile fabric;

the hot melt mechanism includes a first driving component, a functional component driven by the first driving component, and an ultrasonic welding head with a strip-like plane; the functional component is a metal knife mold or a roller mold with a strip-shaped blade edge;

the heat transfer printing mechanism includes a transfer worktable, a second driving component, a hot press plate driven by the second driving component, a transfer feeding material component, and a transfer receiving material component;

the transfer feeding material component and transfer receiving material component are configured to convey and recycle continuous heat transfer paper provided with heat transfer patterns at intervals;

the transfer worktable includes a work plane configured to lay partial continuous textile fabric, as well as a first limit rod and a second limit rod located above the work plane;

the first limit rod and the second limit rod are parallelly provided on two sides of the work plane along the conveying direction of the continuous textile fabric and have a height gap with the work plane, a heat transfer work area is formed between the first limit rod and the second limit rod;

a first section of the continuous textile fabric passes through the height gap and is laid on the work plane, and a second section of the continuous textile fabric passes along the strip-shaped plane of the ultrasonic welding head; during a pause time of conveying the continuous textile fabric, the first driving component and the second driving component are driven simultaneously to transfer patterns at a first position of the first section of the continuous textile fabric and prepare a hot melt tear line at a second position of the second section;

when the hot press plate rises and the transfer receiving material component pulls the continuous heat transfer paper, the first limit rod and the second limit rod limit an upward displacement of the first section to form a force opposite to a movement of the hot press plate and the continuous heat transfer paper.

In an embodiment of the present disclosure, in a first state, after the hot press plate being driven and pressed by the second driving component, pattern on the continuous heat transfer paper below the hot press plate is transferred to an upper surface of the first section; at the same time, intermittent waves from an ultrasonic generator is received by the ultrasonic welding head, and the functional component is driven by the first driving component to act on the second section so as to prepare the hot melt tear line;

in a second state, the hot press plate moves upwards away from the upper surface of the first section, and the transfer receiving material component recycles the continuous heat transfer paper; the first limit rod and the second limit rod limit the upward displacement of the first section to pull and separate the first section from the hot press plate and the continuous heat transfer paper.

In an embodiment of the present disclosure, an auxiliary feeding fabric mechanism is provided between the heat transfer printing mechanism and the hot melt mechanism, the auxiliary feeding fabric mechanism includes a track extending along the conveying direction of the continuous textile fabric and an adaptive adjustment component sliding on the track;

the track is provided with a plurality of track troughs that are parallel, spaced and extending along a length direction; the adaptive adjustment component includes a sliding body extending along a width direction of the track and a supporting cloth claw body;

the supporting cloth claw body has a plurality of claw parts that match the track troughs, a front side of each claw part is provided with an upward slope from front to back; the sliding body moves along the track, a front end of each claw part extends into a corresponding track trough to adaptively adjust forward and backward movement trajectories of the adaptive adjustment component; the claw parts adaptively lift a local section of the continuous textile fabric that is in a low position due to gravity through the upward slope. It should be noted that a plane surface of the towel cloth passing through the auxiliary feeding fabric mechanism is slightly lower than a plane surface of the ultrasonic welding head of the hot melt mechanism, rather than using a straightening method. This is because when the towel cloth in a straightening state, and preparing a hot melt tear section, the tear section will shrink after rapid colling, and it is easy to disconnect.

In an embodiment of the present disclosure, a rear side of the sliding body is provided with a winding cloth roller, and two ends of the winding cloth roller are provided with an annular limit part;

an upper side of the sliding body is provided with a pulling cloth gripper configured for the continuous textile cloth to pass through, and a support surface of a rear end of the supporting cloth claw body is basically flush with a groove bottom of the pulling cloth gripper.

In an embodiment of the present disclosure, the transfer worktable is provided with a correction roller assembly on two sides of the conveying direction of the continuous textile fabric; each correction roller assembly includes three correction rollers that freely rotate, the three correction rollers are a first correction roller, a second correction roller, and a third correction roller from back to front; two ends of each correction roller are provided with a limit ring configured to limit a lateral sliding of the textile fabric;

the continuous textile fabric is wound from above the first correction roller to below the second correction roller, and then wound above the third correction roller before being led forward.

In an embodiment of the present disclosure, the second position is a line with a certain width that spans a width of the continuous textile fabric, and the first position is a corner of a fabric unit formed by an inner edge of the line with a side edge of a width side of the continuous textile fabric;

a graticule extending along the conveying direction of the continuous textile fabric is provided on the work plane.

In an embodiment of the present disclosure, the transfer worktable is provided with a correction roller assembly on two sides of the conveying direction of the continuous textile fabric, and two ends of a correction roller of the correction roller assembly are provided with the limit ring that limit a side edge of the continuous textile fabric;

a position of the correction roller of the correction roller assembly is adjusted according to the graticule to achieve a relative position of the first position in a width direction of the continuous textile fabric.

In an embodiment of the present disclosure, the work plane includes a metal support surface and a silicone support surface, and the silicone support surface is located below the hot press plate.

In an embodiment of the present disclosure, the functional component is a metal knife mold or a roller mold with a strip-shaped blade edge.

In an embodiment of the present disclosure, a continuous textile fabric with patterns and hot melt tear lines, including a base layer and at least one fluff layer on a surface of one side, where the fluff layer is a loop layer or a fuzz layer; and the continuous textile fabric with patterns and hot melt tear lines is prepared through the integrated processing equipment for continuous textile fabric;

the continuous textile fabric is uniformly provided with hot melt tear lines at intervals, the hot melt tear lines run through its width to separate the continuous textile fabric into a plurality of independently separable cloth units;

each fabric unit is provided with a heat transfer pattern at a corner formed by an inner edge of the hot melt tear lines and a side edge of a width side of the continuous textile fabric;

the heat transfer pattern is located on one surface of the fluff layer, and the loops or fuzz below the heat transfer pattern remain standing.

In an embodiment of the present disclosure, an integrated procession method for continuous textile fabric, where the integrated processing equipment for continuous textile fabric is used to synchronously prepare patterns and hot melt tear lines on the continuous textile fabric with loops or fuzz on a surface, and the integrated procession method includes the following steps:

a feeding fabric mechanism and a receiving fabric mechanism being running and pulling forward for a certain length and stopping;

a second driving component driving a hot press plate by a control system command, transferring pattern on continuous heat transfer paper below it to an upper surface of a fluff layer of a first position of a first section of the continuous textile fabric;

when the second driving component being running, a first driving component acting on a functional component; at this time, receiving intermittent waves from an ultrasonic generator by an ultrasonic welding head, and the functional component working together with the ultrasonic welding head on two surfaces of the continuous textile fabric to prepare a hot melt tear line in a second section;

simultaneously rebounding the second driving component and first driving component;

when the hot press plate being rebounded by the second driving component, recycling the heat transfer paper by a transfer material receiving component; separating a first position of the continuous textile fabric from the heat transfer paper by pulling up and down, lifting up previously pressed loops or fuzz by hot transfer again through a separation force;

when a color code sensor illuminating the pattern, stopping receiving material by the transfer material receiving component;

the feeding fabric mechanism and the receiving fabric mechanism repeating a next pulling operation.

In an embodiment of the present disclosure, a continuous textile fabric with patterns and hot melt tear lines, including a base layer and at least one fluff layer on a surface of one side, where the fluff layer is a loop layer or a fuzz layer, and the continuous textile fabric with patterns and hot melt tear lines is prepared through the integrated procession method for continuous textile fabric, where the continuous textile fabric is uniformly provided with hot melt tear lines at intervals that run through its width to separate the continuous textile fabric into a plurality of independently separable fabric units;

each fabric unit is provided with a heat transfer pattern at a corner formed by an inner edge of the hot melt tear line and a side edge of a width side of the continuous textile fabric, the heat transfer pattern is located on one surface of the fluff layer; and the loops or fuzz below the heat transfer pattern remain standing.

In an embodiment of the present disclosure, the hot press plate of the heat transfer printing mechanism is connected to a copper pattern concave-convex template, and the copper patterned concave convex template is provided with a layer of resistant high-temperature insulation tape, a process of using the hot press plate to connect the resistant high-temperature insulation tape to form a concave convex pattern on a hot-pressed towel cloth is unexpected.

Compared with existing technology, the advantages of the present disclosure are:

firstly, compared with traditional step-by-step preparation, the integrated processing equipment for continuous textile fabric synchronously links the heat transfer printing mechanism and the hot melt mechanism to simultaneously heat transfer patterns and prepare hot melt tear lines within a pause cycle, thereby solving a problem of high labor and time consumption in two-processes production, significantly improving a production efficiency. And in traditional technology, pattern position of the fabric unit is prone to change, which does not meet requirements of mass production. Heat transfer printing and hot melt are produced synchronously, ensuring that the pattern position on torn single towel is fixed and improving aesthetics.

Secondly, the first limit rod and second limit rod limit the upward displacement of the first section to form a force opposite to the movement of the hot press plate and continuous heat transfer paper. This allows the loops or fuzz underneath the prepared heat transfer pattern to be pulled up again to maintain standing, thereby rendering the fluff layer on two surfaces of the textile fabric after being heat transferred still soft and fluffy, not only more aesthetically pleasing but also maintaining high water-absorption properties of ultra-fine fiber towels.

Thirdly, the equipment prepares hot melt tear lines for towel cloths, which can be torn along the tear lines without any drawing and can be used to prepare towel cloths with different thicknesses by adjusting ultrasonic wave duration and power, thereby greatly improving the production efficiency. This equipment can produce both heat transfer patterns and continuous tear-off towels with concave-convex patterns to meet aesthetic requirements of different customers.

BRIEF DESCRIPTION OF DRAWINGS

The following will provide a further detailed description of the present disclosure in combination with the accompanying drawings and preferred embodiments. However, those skilled in the art will appreciate that these drawings are only drawn for a purpose of explaining preferred embodiments and should not be used as a limitation on the scope of the present disclosure. In addition, unless otherwise specified, the drawings only represent a composition or construction of a described object conceptually and may contain exaggerated displays, and the drawings are not necessarily drawn to scale.

DESCRIPTION OF EMBODIMENTS

Figure 1:
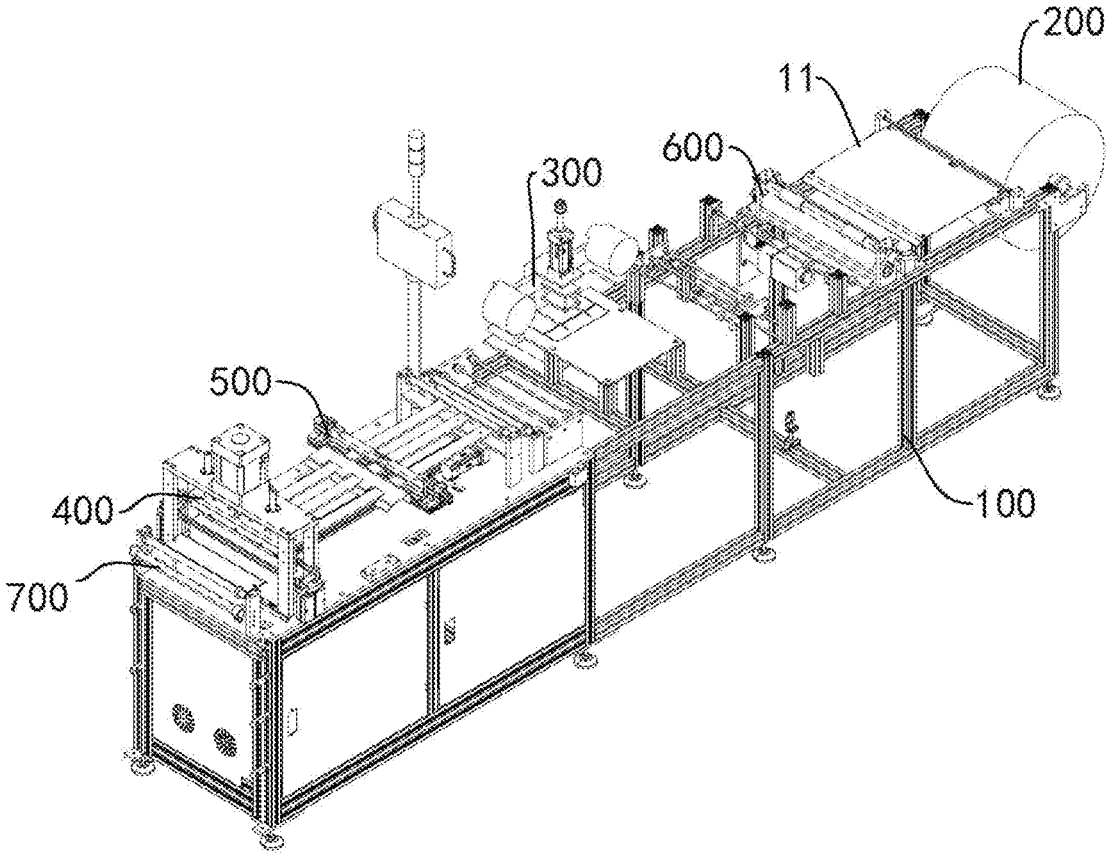
FIG. 1 is a schematic diagram of an integrated processing equipment for continuous textile fabric.

The preferred embodiments of the present disclosure will be described in detail below with reference to the accompanying drawings. Those skilled in the art will understand that these descriptions are only descriptive, exemplary, and should not be interpreted as limiting the protection scope of the present disclosure.

In the description of the present disclosure, it should be noted that terms “up”, “down”, “front”, “back”, “left”, "right", "inside", "outside", etc. indicate that an orientation or position relationship based on the orientation or position relationship shown in the drawings, or the orientation or position relationship habitually placed when a product of the present disclosure is used, is only for a convenience of describing the present disclosure and simplifying the description, and does not indicate or imply that the device or component referred to must have a specific orientation, be constructed and operated in a specific orientation, and therefore cannot be understood as a limitation of the present disclosure. "First" and "second" are only for easy-to-understand descriptions and have no other directional meanings and cannot be used as limitations on the present disclosure.

It should be noted that similar number reference represents similar terms in the following drawings. Therefore, once a term is defined in one drawing, it may not be further defined and explained in subsequent drawings.

Figure 2:
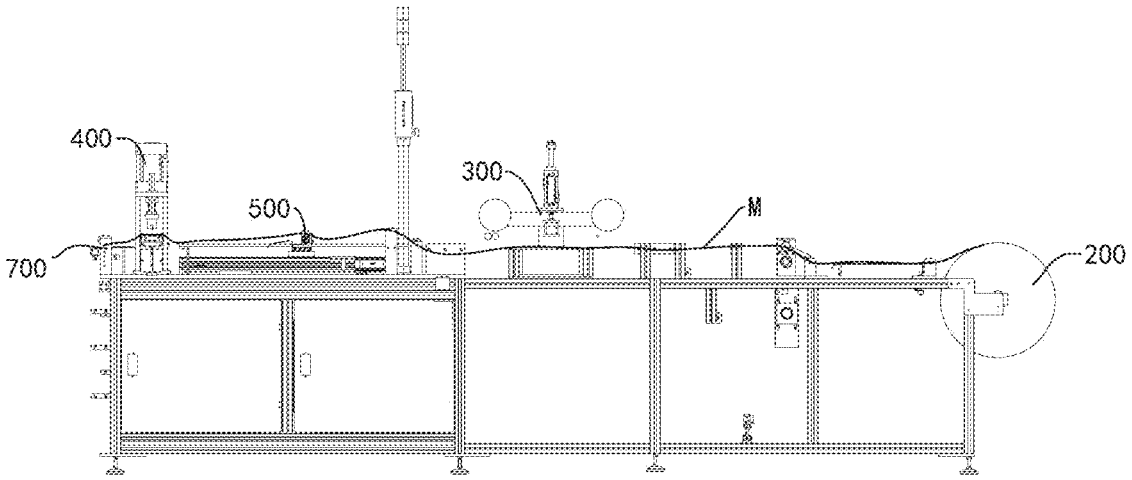
FIG. 2 is a schematic diagram of an operation of the integrated processing equipment for continuous textile fabric.

As shown in FIGS. 1-2, this embodiment provides an integrated processing equipment for continuous textile fabric, which is configured to process continuous textile fabric with patterns and hot melt tear lines as shown in FIGS. 11-14. The continuous textile fabric is a continuous towel cloth M with of loops n or fuzz on a surface. This continuous towel cloth M includes a base layer M1 and at least one fluff layer M2 on a surface of one side, the fluff layer M2 is a loop layer or a fuzz layer.

This integrated processing equipment for continuous textile fabric includes a strip-shaped rack 100 and a feeding fabric mechanism 200, a receiving fabric mechanism 700, a heat transfer printing mechanism 300, and a hot melt mechanism 400 provided along the rack 100.

As shown in FIGS. 1-2, the feeding fabric mechanism 200 and the receiving fabric mechanism 700 are used in combination to convey the continuous textile fabric M along a length direction and pause at working cycle intervals. During a pausing working cycle, the heat transfer printing mechanism 300 heat transfers pattern S1 at a first position of the continuous textile fabric M, and the hot melt mechanism 400 prepares a hot melt tear line S2 that spans a width of the continuous textile fabric M at a second position of the continuous textile fabric M. Pattern S1 is one or a combination of graphics or text, and generally includes product information such as textile fabric trademark or care label.

Figure 4:
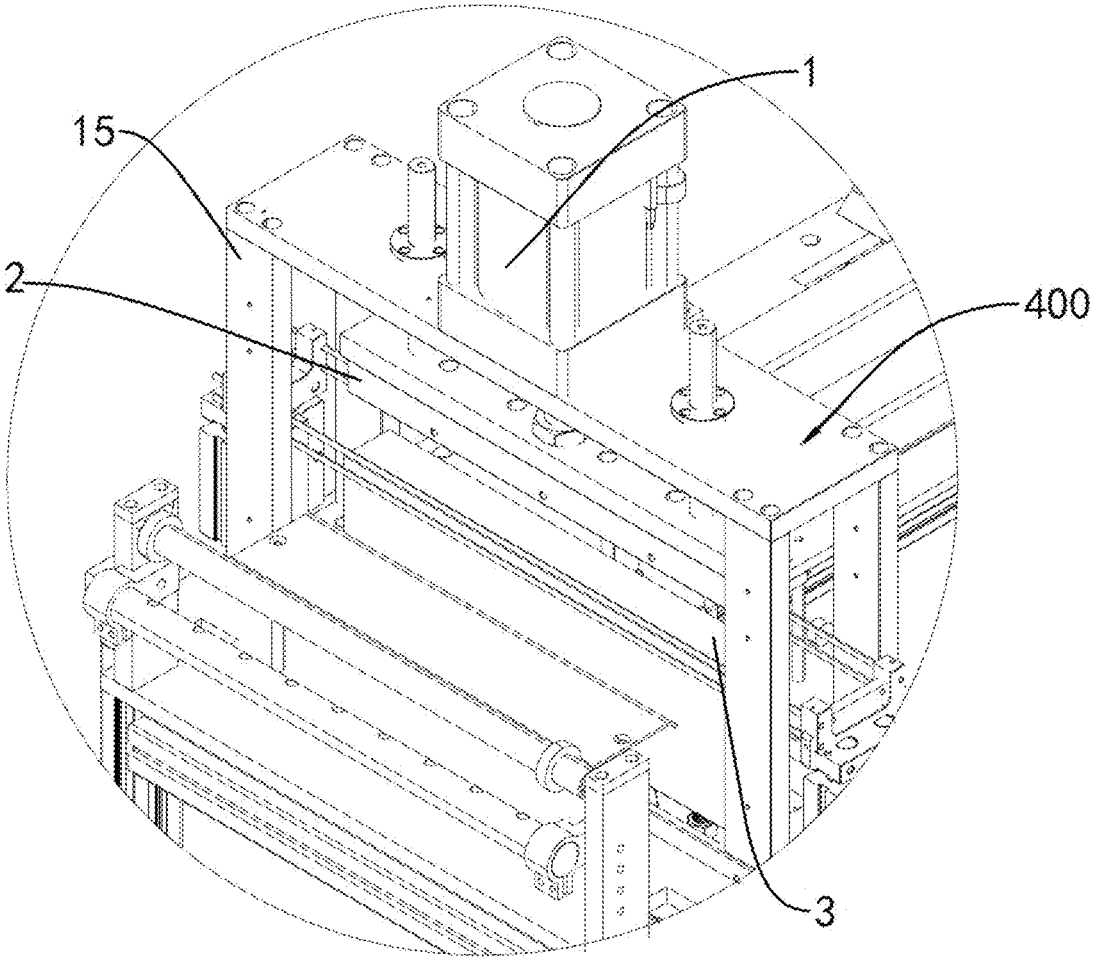
FIG. 4 is a first schematic diagram of a relevant structure of a hot melt mechanism of the integrated processing equipment for continuous textile fabric.

As shown in FIG. 4, the hot melt mechanism 400 includes a first driving component 1, a functional component 2 driven by the first driving component 1, and an ultrasonic welding head 3 with a strip-like plane. In this embodiment, the functional component 2 is a metal knife mold with a strip-shaped blade edge.

Figure 3:
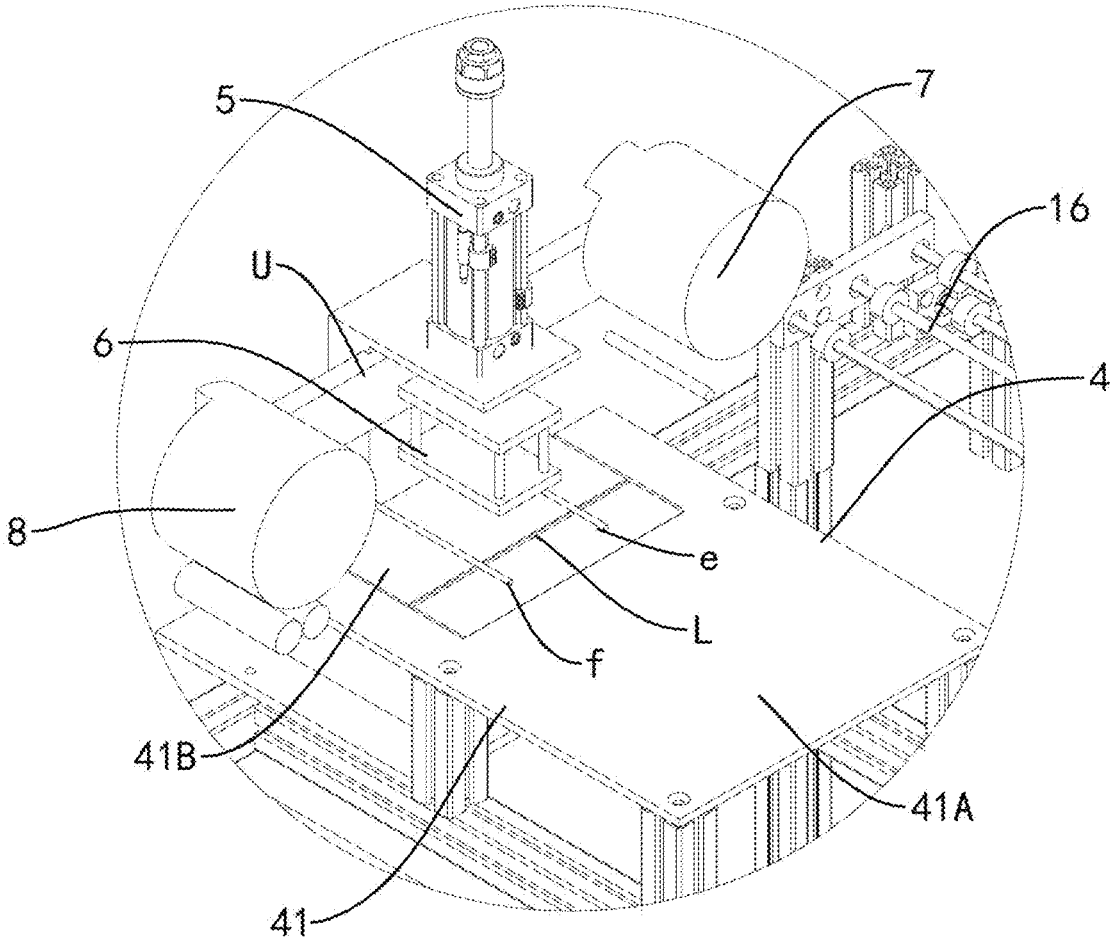
FIG. 3 is a schematic diagram of a relevant structure of a heat transfer printing mechanism of the integrated processing equipment for continuous textile fabric.

As shown in FIG. 3, the heat transfer printing mechanism 300 includes a transfer worktable 4, a second driving component 5, a hot press plate 6 driven by the second driving component 5, a transfer feeding material component 7, and a transfer receiving material component 8. The transfer worktable 4 includes a work plane 41 for laying partial continuous textile fabric M. The hot press plate 6 is located on the work plane 41, and the transfer feeding material component 7 and the transfer receiving material component 8 are located on two sides of the hot press plate 6. The transfer feeding material component 7 and the transfer receiving material component 8 are configured to convey and recycle heat transfer paper with heat transfer pattern S1 (not shown in the drawing). In an implementation, both the first driving component 1 and the second driving component 5 are a cylinder.

As shown in FIGS. 2 and 3, the continuous textile fabric M is led out from one end of the feeding fabric mechanism 200. Under an action of the feeding fabric mechanism 200 and the receiving fabric mechanism 700, it extends upstream along a length of the integrated processing equipment for continuous textile fabric. A first section of the continuous textile fabric M passes through the work plane 41; a second section of the continuous textile fabric M passes through the hot melt mechanism 400.

During a pause time of conveying the continuous textile fabric M, after being driven and pressed down by the second driving component 5, the hot press plate 6 transfers the pattern on the heat transfer paper below it to an upper surface of the first position of the first section. At the same time, the hot melt mechanism 400 prepares the hot melt tear line S2 at a second position in the second section of the continuous textile fabric M.

Through this equipment, the continuous textile fabric M with loops n or fuzz on the surface can simultaneously prepare patterns and hot melt tear lines S2. This continuous textile fabric M includes a base layer M1 and at least one fluff layer M2 on a surface of one side, the fluff layer M2 is a loop layer or a fuzz layer. In an implementation, the fluff layer M2 of the continuous textile fabric M is ultra-fine fibers. The fiber size of the ultra-fine fibers ranges from 0.1 to 0.5 deniers, with a diameter of less than 5 microns. The fiber fineness is 1/200 of that of hair, 1/20 of that of ordinary chemical fibers, and the fiber strength is 5 times that of ordinary fibers with adsorption capacity. Therefore, the loops n on two surfaces of this ultra-fine fiber textile towel cloth is soft and fluffy, and water absorption speed and amount are 7 times that of ordinary fibers.

A preparation method for continuous textile fabric M with loops n or fuzz on one surface by the integrated equipment to prepare patterns and hot melt tear lines S2 includes the following steps:

after the equipment is running, the feeding fabric mechanism 200 and the receiving fabric mechanism 700 pulling forward for a certain length and stopping; a first section of the continuous textile fabric M is located on a work plane 41. Before this pause, all components should be in a normal working condition, including the hot press plate 6 located above the work plane 41, the heat transfer paper located on a lower surface of the hot press plate 6, and the heat transfer paper located on a lower surface of the hot press plate 6 having transfer patterns.

During this pause, the heat transfer printing mechanism 300 and the hot melt mechanism 400 operate simultaneously. The second driving component 5 is driven by a control system command to drive the hot press plate 6, transferring the pattern on the continuous heat transfer paper below it to an upper surface of the fluff layer M2 of the first position of the first section of the continuous textile fabric M. While the second driving component 5 is running, the first driving component 1 is running the functional component 2. At this time, the ultrasonic welding head 3 receives intermittent waves from an ultrasonic generator. The functional component 2 and the ultrasonic welding head 3 work together on both surfaces of the continuous textile fabric M to prepare a hot melt tearing section in the second section. This intermittent ultrasonic wave generation method can be used to prepare hot melt tear sections with different thicknesses for towel cloth by adjusting parameters such as ultrasonic wave generation time and ultrasonic power. This not only ensures tearability of the hot melt tear section, but also improves production efficiency of different work order changes.

After the transfer and hot melt are completed, both the second driving component 5 and the first driving component 1 rebound simultaneously. When the second driving component 5 rebounds the hot press plate 6, the transfer material receiving component 8 recycles the heat transfer paper. The first position of the continuous textile fabric M is pulled and separated from the heat transfer paper by pulling up and down, and previously pressed loops n or fuzz is lift up by a separation force. When a color code sensor illuminates the pattern, the transfer material receiving component 8 stops receiving material. At this time, one cycle of synchronization operation has been completed. The feeding fabric mechanism 200 and the receiving fabric mechanism 700 run again and repeat a next pulling operation to convey the continuous textile fabric M forward.

The continuous textile fabric M prepared by this equipment and method is uniformly provided hot melt tear lines S2 at intervals that run through its width to separate the continuous textile fabric M into a plurality of independently separable fabric units. And each fabric unit is provided with a heat transfer pattern at a corner formed by an inner edge of the hot melt tear line S2 and a side edge of a width side of the continuous textile fabric M. The heat transfer pattern is provided on one surface of the fluff layer M2, and the loops n or fuzz below the heat transfer pattern remain standing. Of course, the position of pattern S1 can also be fixed at any specified position on the towel cloth.

Compared with traditional step-by-step preparation, synchronous preparation solves a problem of high labor and time consumption in two production processes, significantly improving a production efficiency. And in traditional technology, the pattern position of the fabric unit is prone to change, which does not meet requirements of mass production. The heat transfer printing and hot melt of this integrated equipment are produced synchronously, thereby ensuring that the pattern position on a torn single piece continuous textile fabric M is fixed and improving aesthetics.

In an implementation, as shown in FIG. 3, a first limit rod e and a second limit rod f are provided above the work plane 41 under the hot press plate 6 of the integrated processing equipment for continuous textile fabric; the first limit rod e and the second limit rod f are parallelly provided at two sides of the work plane 41 along a conveying direction of the continuous textile fabric M and have a height gap with the work plane 41. A heat transfer work area is formed between the first limit rod e and the second limit rod f. The first section of the continuous textile fabric M passes through the height gap and is laid on the work plane 41. When the hot press plate 6 rises and the transfer receiving material component 8 pulls the continuous heat transfer paper, the first limit rod e and the second limit rod f limit an upward displacement of the first section to form a force opposite to a movement of the hot press plate 6 and the continuous heat transfer paper.

That is to say, in a first state, the hot press plate 6 is driven by the second driving component 5 to pass through the heat transfer work area between the first limit rod e and the second limit rod f, and then the pattern on the continuous heat transfer paper below it is transferred to the upper surface of the fluff layer M2 of the first section. This process is a first-time period.

Within the first time period, the ultrasonic welding head 3 receives intermittent waves from the ultrasonic generator, and the functional component 2 acts on the hot melt tear line S2 in the second section under a drive of the first driving component 1. A process that the functional component 2 is driven to cooperate with the ultrasonic welding head 3 to press the hot melt tear line S2 is a second-time period.

The first-time period is slightly longer than the second time period, that is, the heat transfer printing is executed with priority. The second driving component 5 can be driven synchronously with the first driving component 1, or it can send an associated command to the first driving component 1 after being driven by the second driving component 5, so that it can closely follow a subsequent drive. For example, providing with a sensor, when the second driving component 5 drives the hot press plate 6 to descend a certain height, the sensor senses a signal and sends it to a control unit of the first driving component 1, and the first driving component 1 is caused to drive. Of course, this integrated device can also be connected through the same control system to coordinate the operation of the two mechanisms. There is a synchronization mechanism between the first driving component 1 and the second driving component 5 to coordinate a rhythm of the heat transfer printing process and the hot melt process.

In a second state, the second driving component 5 drives the hot press plate 6 to move upwards away from the upper surface of the first section, and at the same time, the transfer receiving material component 8 recycles the continuous heat transfer paper. The first limit rod e and the second limit rod f limit the upward displacement of the first section, thereby ensuring that when a heat imprinting part is combined to the heat transfer paper and the heat transfer paper do not adhere to the heat press plate 6, a failure of the transfer material receiving component 8 during recycling and a difficulty of subsequent fabric pulling caused by the failure to separate the two are reduced. And, with the limitations of the first limit rod e and the second limit rod f, the first section is separated from the hot press plate 6 and the continuous heat transfer paper by pulling up and down. Especially, the separation of the transfer pattern with the heat transfer paper is changed from a frictional horizontal separation to an upward-and-downward pulling separation. The upward-and-downward pulling separation force brings back the previously pressed loops n and fuzz, so that the loops n or fuzz below the prepared heat transfer pattern remain standing. The fluff layer M2 on two surfaces of the textile fabric after being heat transferred still soft and fluffy, which not only renders it more aesthetically pleasing but also maintain high water-absorption properties of ultra-fine fiber towels.

Figure 5:
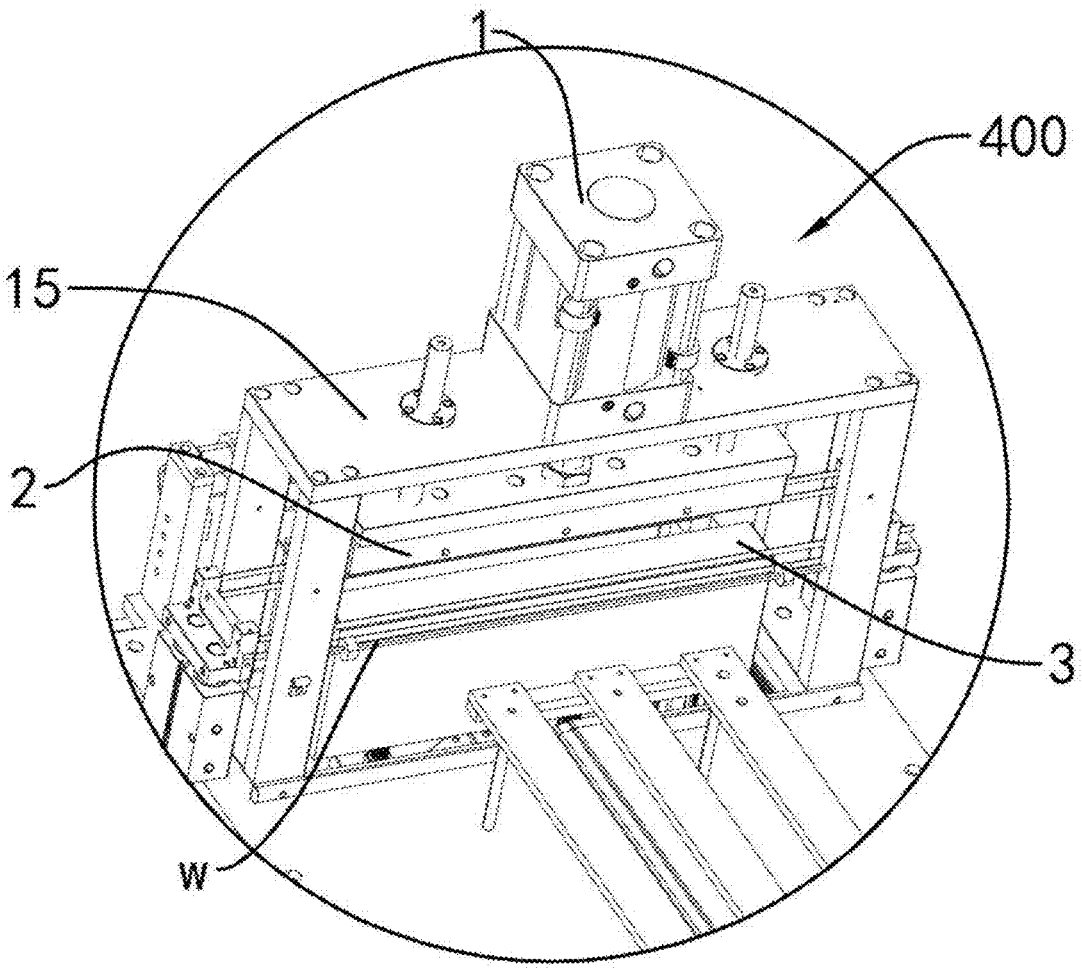
FIG. 5 is a second schematic diagram of a relevant structure of the hot melt mechanism of the integrated processing equipment for continuous textile fabric.

In this embodiment, as shown in FIGS. 4 and 5, the functional component 2 of the hot melt mechanism 400 is a metal knife mold, and the action of the first driving component 1 is activated by providing with a sensor at a certain moment after the driving of the second driving component 5. At the same time, the rebound of the first driving component 1 is also linked with the second driving component 5 through the sensor. This can maintain a consistency between the heat transfer printing and hot melt processes, thereby preventing any component from rebounding and making mistakes during drawing fabric and ensuring that the position of the heat transfer printing on each fabric unit is fixed.

In an implementation, as shown in FIG. 3, the transfer feeding material component 7 and the transfer receiving material component 8 are both parallel wheel axle structures, and the heat transfer paper is a continuous heat transfer paper with heat transfer patterns spaced at intervals; the continuous heat transfer paper between the transfer feeding material component 7 and the transfer receiving material component 8 passes through a lower surface of the hot press plate 6. After one transfer is completed, the transfer receiving material component 8 recycles the material, and the continuous heat transfer paper moves away from a bottom of the hot press plate 6, while a latter part with the heat transfer pattern comes to the bottom of the hot press plate 6.

As shown in FIGS. 1-2, there is an auxiliary feeding fabric mechanism 200 between the heat transfer printing mechanism 300 and the hot melt mechanism 400. This is because in order to avoid a mutual interference between the heat transfer printing mechanism 300 and the hot melt mechanism 400, especially a mutual influence of thermal effects, the heat transfer printing mechanism 300 and the hot melt mechanism 400 are usually separated by a relatively long distance. The operation of the heat transfer printing mechanism 300 and the hot melt mechanism 400 at a similar height is more conducive to a stability of the fabric conveying operation, which is also more conducive to an accuracy of the pattern and the position of the hot melt tear line S2. In this case, a distance between the fabric and the rack 100 is generally small, and a sagging of the fabric not only affects a stability of conveying but also easily leads to faults such as fabric being stuck. And the auxiliary feeding fabric mechanism 200 is provided based on this reason.

Figure 6:
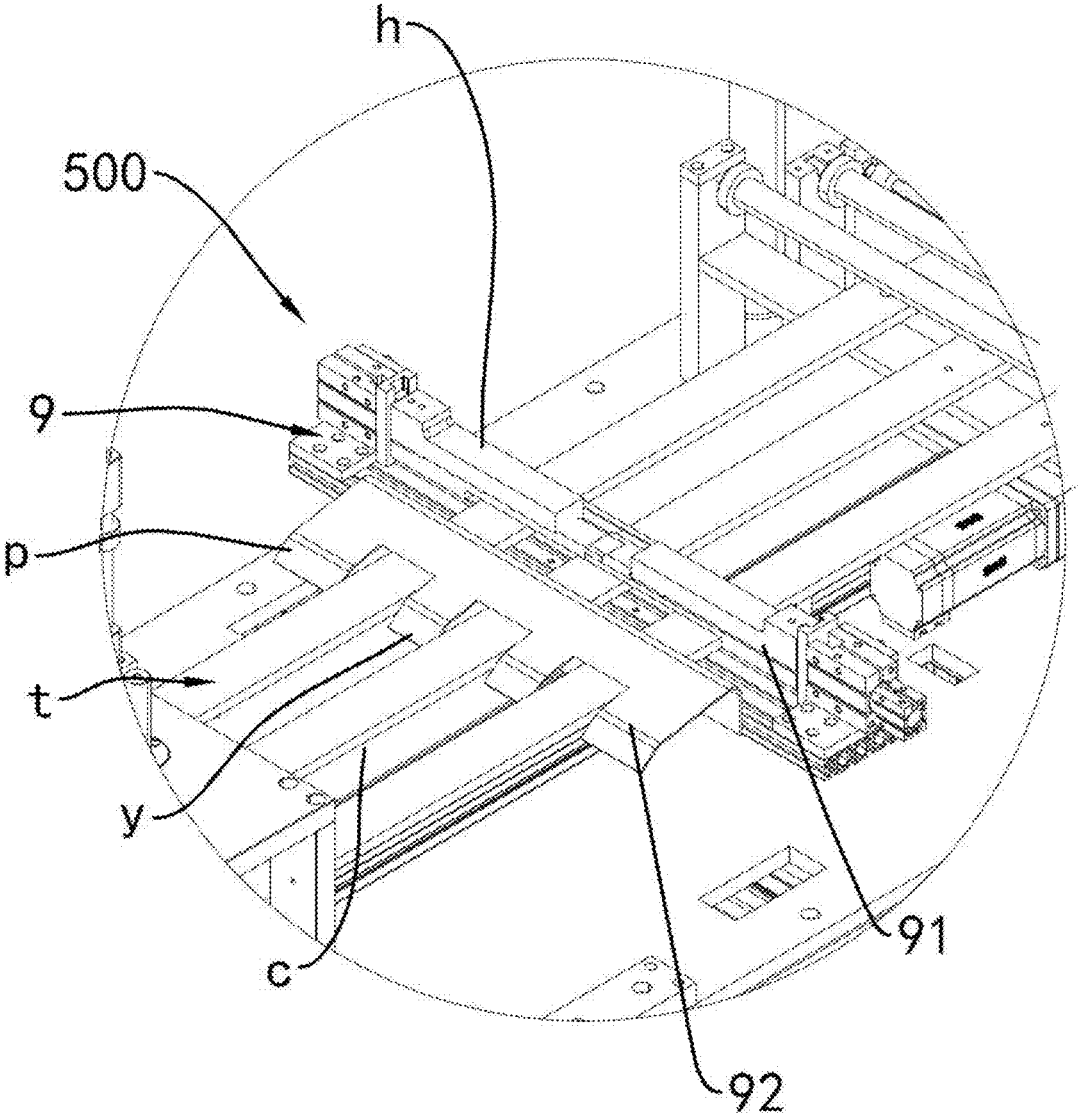
FIG. 6 is a first schematic diagram of a relevant structure of an auxiliary feeding fabric mechanism of the integrated processing equipment for continuous textile fabric.
Figure 7:
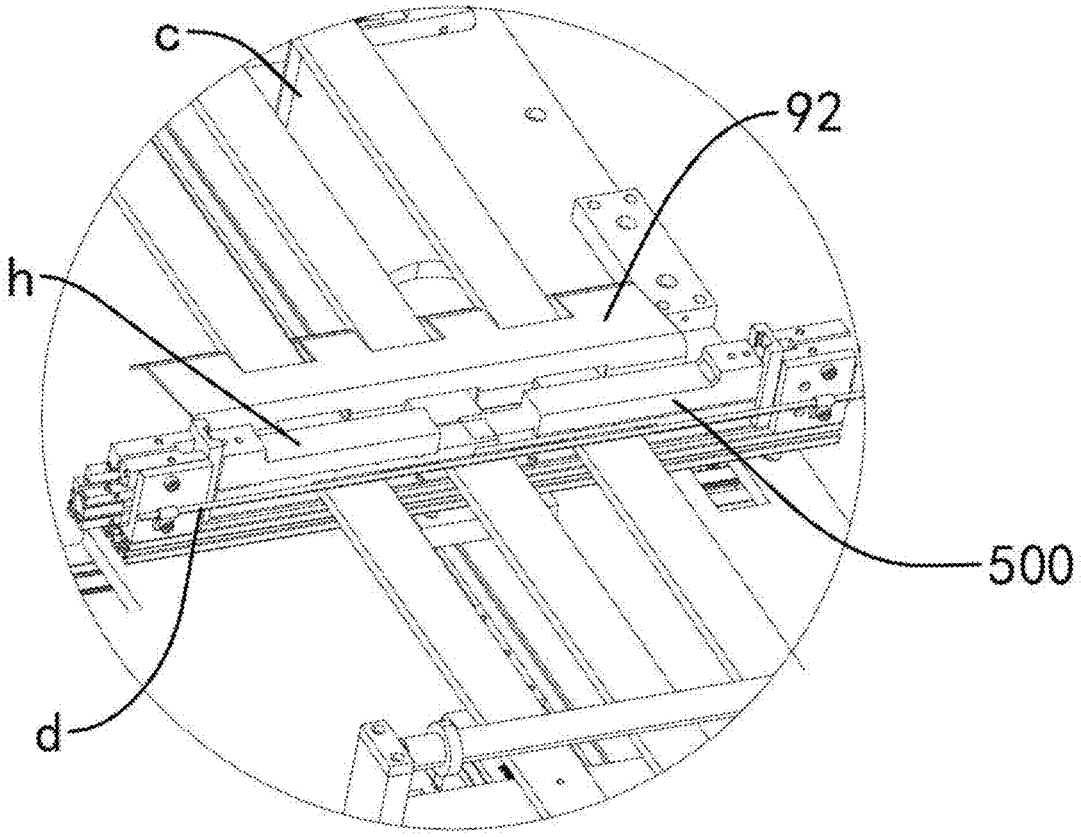
FIG. 7 is a second schematic diagram of a related structure of the auxiliary feeding fabric mechanism of the integrated processing equipment for continuous textile fabric.

As shown in FIGS. 6 and 7, the auxiliary feeding fabric mechanism 200 includes a track t extending along the conveying direction of the continuous textile fabric M and an adaptive adjustment component 9 sliding on the track t. The track t is provided with a plurality of track troughs c that are parallel, spaced and extending along a length direction; the adaptive adjustment component 9 includes a sliding body 91 extending along a width direction of the track t and a supporting cloth claw body 92.

The supporting cloth claw body 92 has a plurality of claw parts p that match the track troughs c, a front side of each claw part p is provided with an upward slope y from front to back; the sliding body 91 moves along the track t, and a front end of each claw p extends into a corresponding track trough c to adaptively adjust forward and backward movement trajectories of the adaptive adjustment component 9. The claws parts p adaptively lift a local section of the continuous textile fabric M that is in a low position due to gravity through the upward slope y.

In an implementation, as shown in FIG. 7, a rear side of the sliding body 91 is provided with a winding cloth roller d, and two ends of the winding cloth roller d are provided with an annular limit part. An upper side of the sliding body 91 is provided with a pulling cloth gripper h configured for the continuous textile cloth M to pass through, and a support surface of a rear end of the supporting cloth claw body 92 is basically flush with a groove bottom of the pulling cloth gripper h. The winding cloth roller d and the pulling cloth gripper h guide and adjust a lateral position of the continuous textile fabric M for better straightness during conveying. Moreover, the entire auxiliary feeding fabric mechanism 200 adaptively adjusts its position based on tension of the fabric, which is more conducive to the stable conveying of the fabric.

Figure 10:
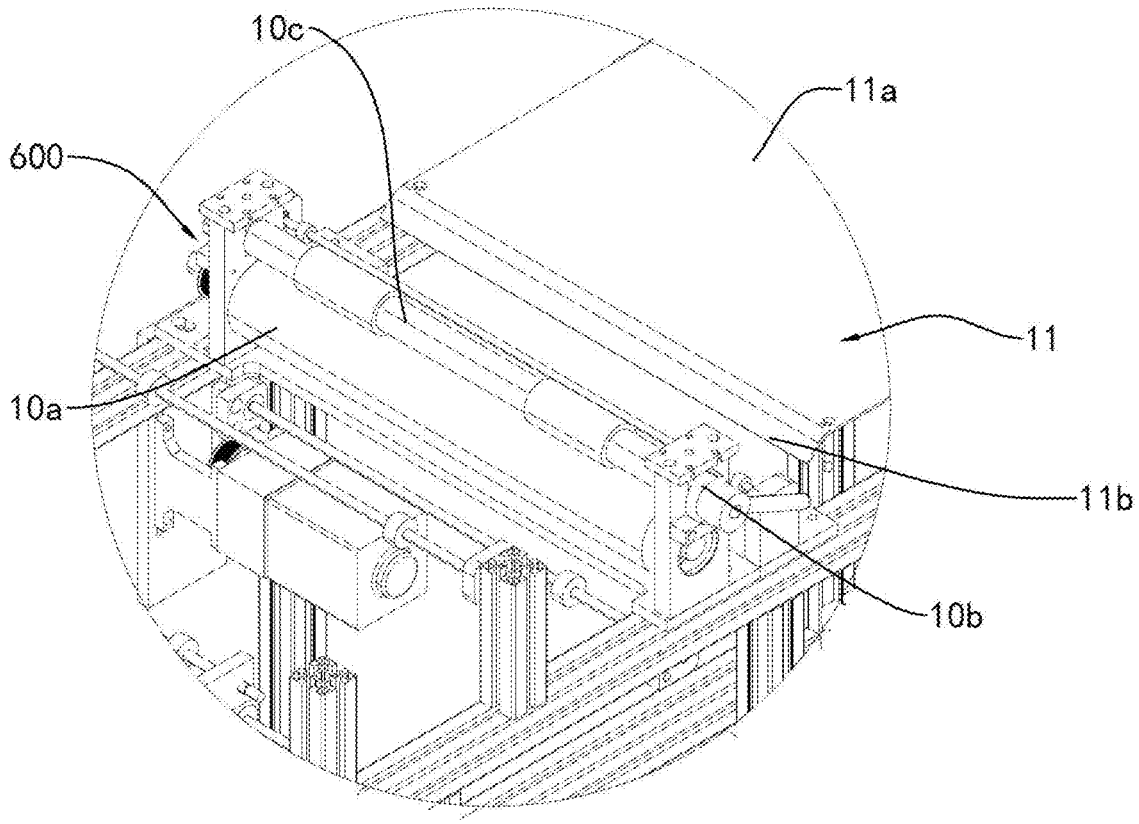
FIG. 10 is a schematic diagram of a relevant structure of a leveling fabric mechanism of the integrated processing equipment for continuous textile fabric.
Figure 11:
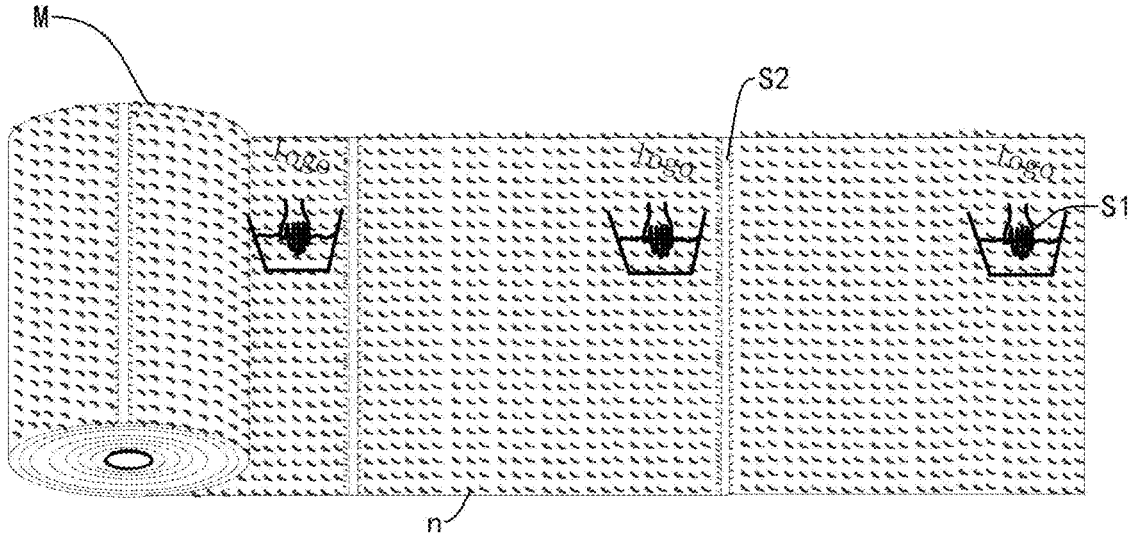
FIG. 11 is a first schematic diagram of a continuous textile fabric with patterns and hot melt tear lines.
Figure 12:
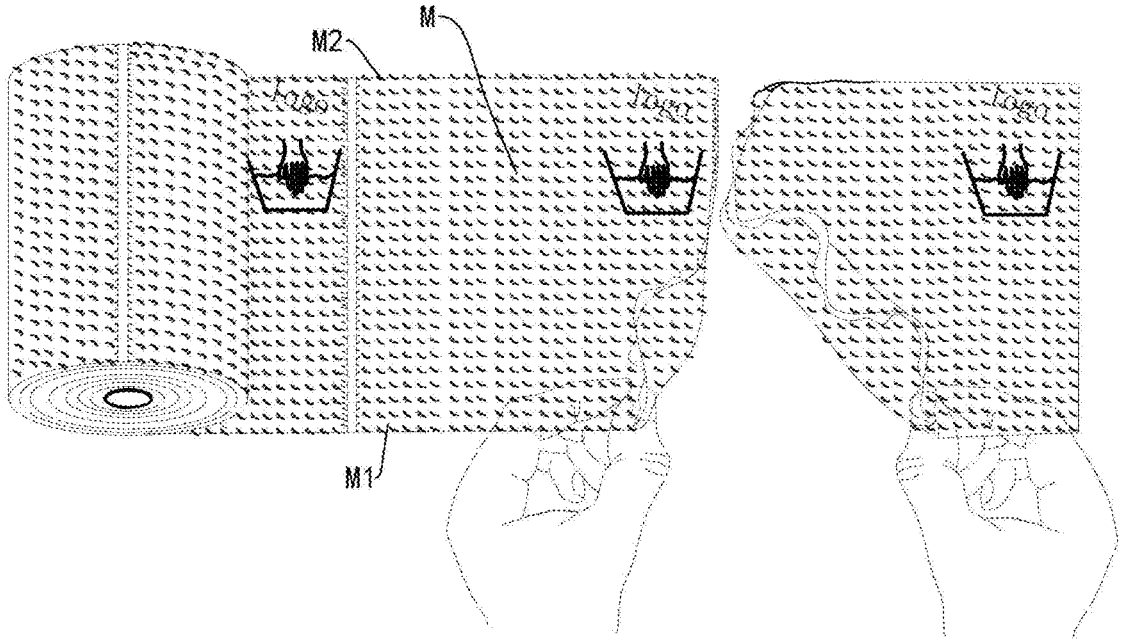
FIG. 12 is a second schematic diagram of the continuous textile fabric with patterns and hot melt tear lines.
Figure 13:
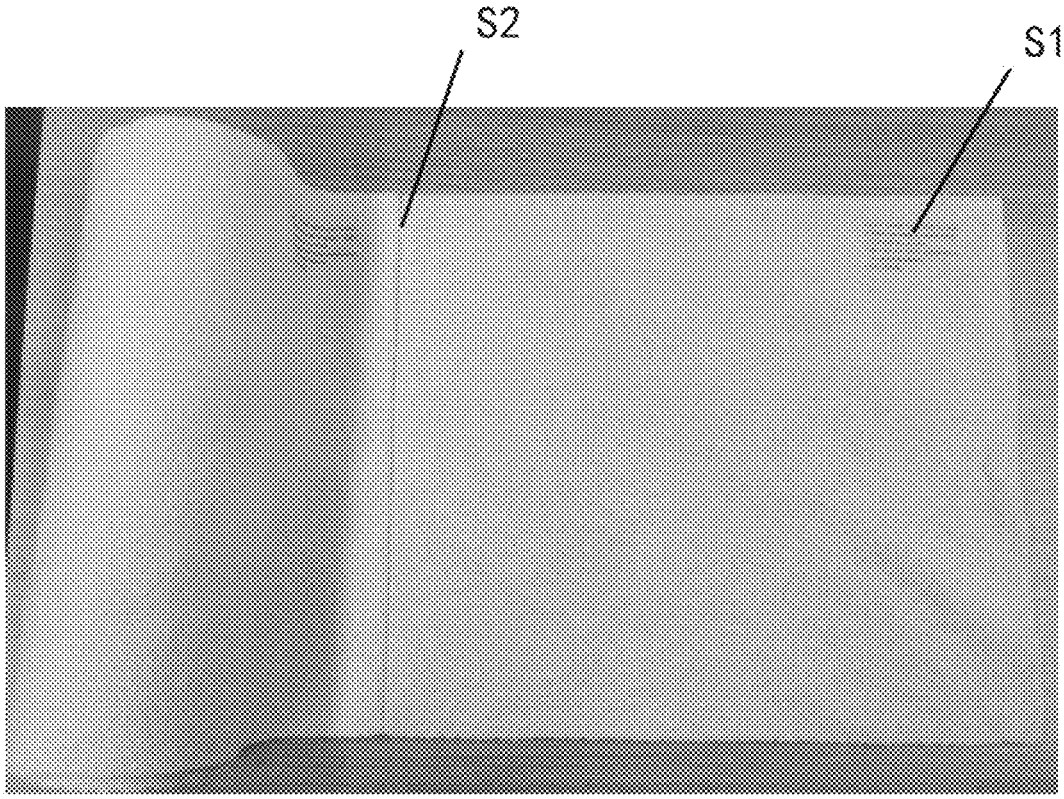
FIG. 13 is a first physical photo of the continuous textile fabric with patterns and hot melt tear lines.

As shown in FIG. 10, the feeding fabric mechanism 200 includes a fabric feeding rack, a fabric base of the continuous textile fabric M is provided on the fabric feeding rack, and led out from an upper side to a next mechanism. One side of the feeding fabric mechanism 200 is provided with a leveling fabric mechanism 10, which includes a leveling fabric roller 10*a*, a motor, a transmission shaft, and a crank rocker mechanism 10*b*. The crank rocker mechanism 10*b* is provided with an anti-stuck rod assembly 10*c*, and the motor drives the transmission shaft to drive the crank rocker mechanism 10*b* to run. The continuous textile fabric M passes through the leveling fabric roller 10*a* and the anti-stuck rod assembly 10*c*. The feeding fabric mechanism 200 clamps and feeds the fabric according to a set frequency. When the crank rocker mechanism 10*b* swings at the set frequency, it drives the anti-stuck rod assembly 10*c* to avoid fabric being stuck on the leveling fabric roller 10*a*.

Figure 9:
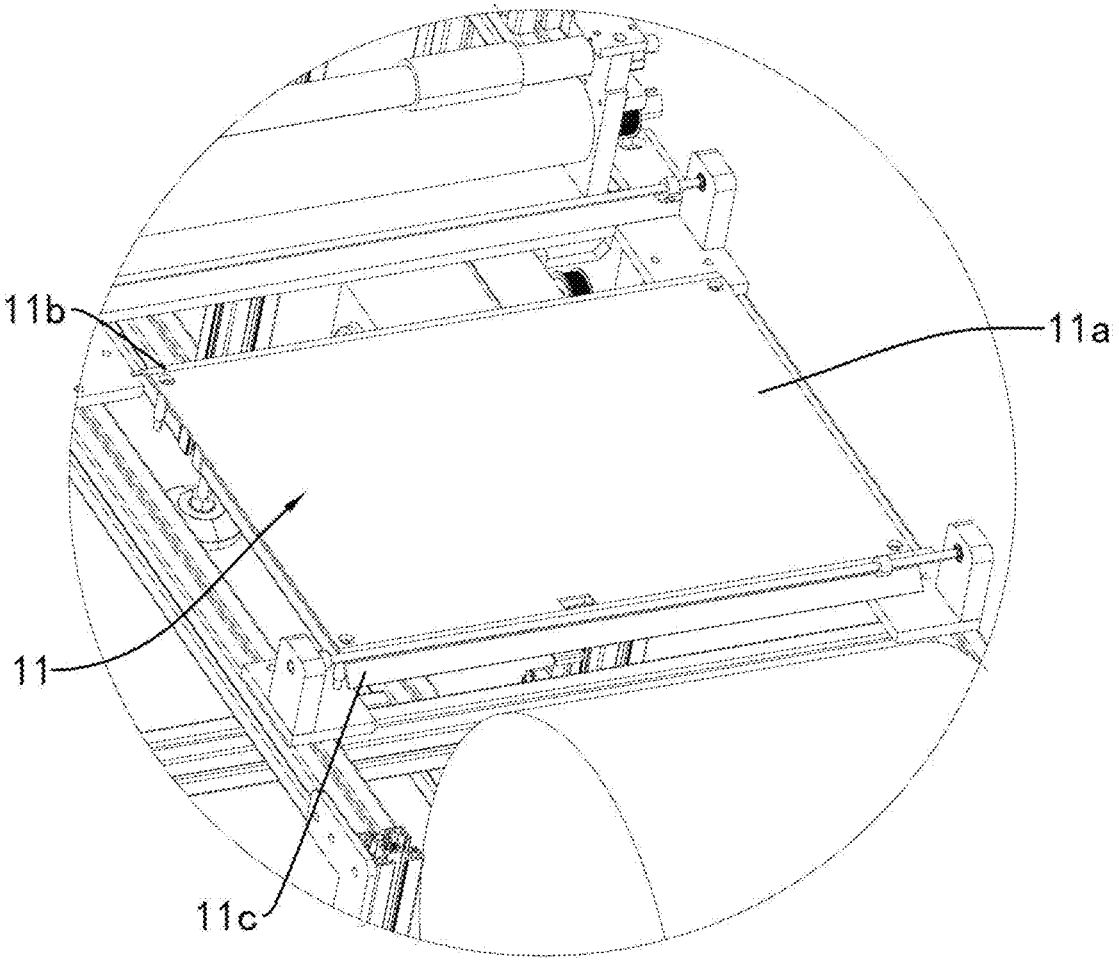
FIG. 9 is a schematic diagram of a relevant structure of a fabric rack of the integrated processing equipment for continuous textile fabric.

In an implementation, as shown in FIG. 9-10, there is also a fabric rack 11 between the fabric feeding rack and the leveling fabric mechanism 10. The fabric rack 11 includes a flat plate portion 11*a*, and front and rear sides of the flat plate portion 11*a* are bent downwards to form a front slope surface 11*b* and a back slope surface 11*c*, a front section of the front slope surface 11*b* is provided with a first winding wheel 12 located on it, and a rear side of the back slope surface 11*c* is provided with a second winding wheel 13. The first winding wheel 12 and the second winding wheel 13 are higher than an upper plane of the flat plate portion 11*a*, and a guide gap is formed between the front slope surface 11*b* and the first winding wheel 12. The fabric on the fabric feeding rack is wound from top to bottom through a lower side of the first winding wheel 12, and pulled out along the guide gap to a top of the flat plate portion 11*a*. Then, it is wound from below the second winding wheel 13 onto the leveling fabric mechanism 10, and the back slope surface 11*c* can avoid damage to the fabric.

As shown in FIG. 5, the hot melt mechanism 400 is provided in a hot melt frame 15, and there is a guide winding roller assembly on two sides of the hot melt frame 15. Each guide winding roller assembly includes a plurality of guide winding rollers w that are parallel and staggered in height. Two ends of each guide winding roller w are also provided with a convex ring structure for limiting a current lateral movement of the fabric.

Figure 8:
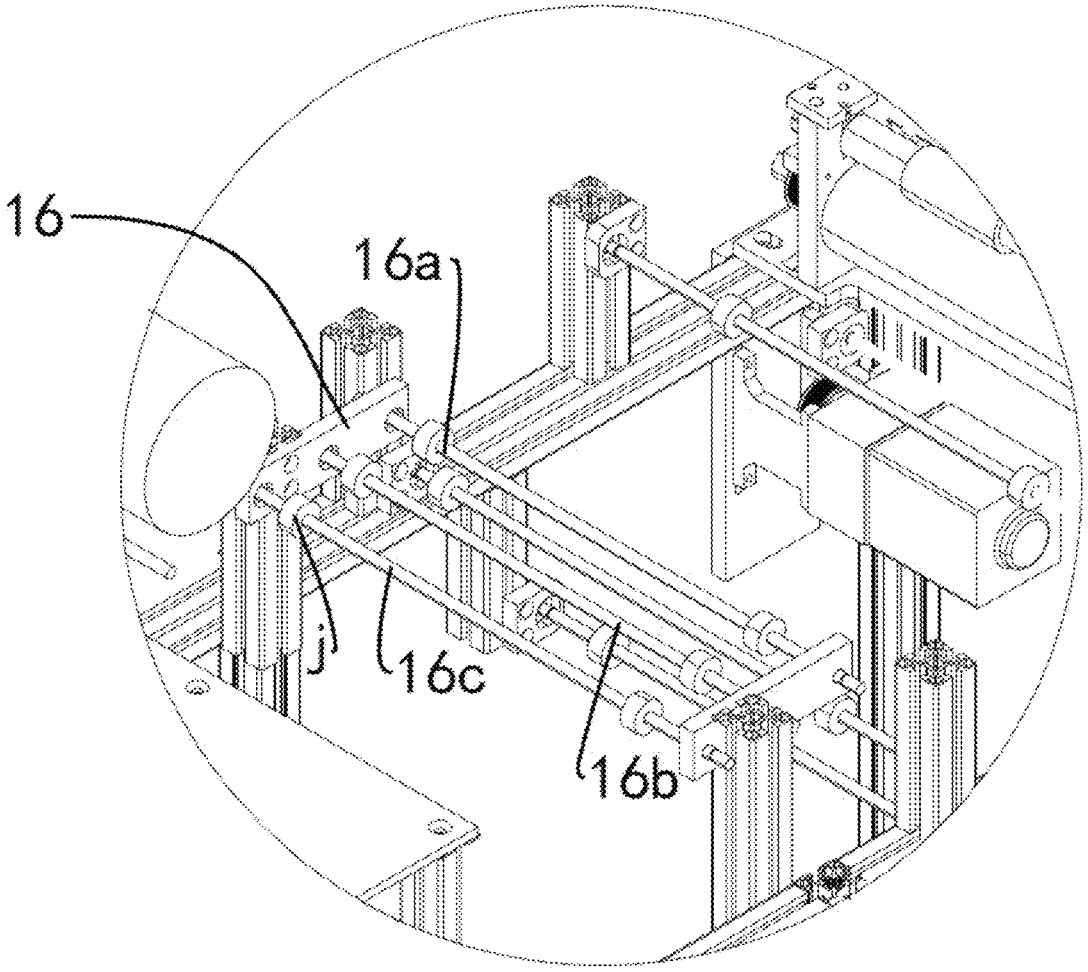
FIG. 8 is a schematic diagram of a relevant structure of a correction roller assembly of the integrated processing equipment for continuous textile fabric.

As shown in FIG. 8, the transfer printing worktable 4 is provided with a correction roller assembly 16 on two sides of the conveying direction of the continuous textile fabric M; each correction roller assembly 16 includes three correction rollers that freely rotate, the three correction rollers are a first correction roller 16*a*, a second correction roller 16*b*, and a third correction roller 16*c* from back to front; two ends of each correction roller are provided with a limit ring configured to limit a lateral sliding of the fabric. The continuous textile fabric M is wound from a top of the first correction roller 16*a* to a bottom of the second correction roller 16*b*, and then wrapped above the third correction roller 16*c* before being led out forward. When passing through the correction roller assembly 16 before and after passing through the fabric, if there is a lateral position deviation, the correction roller can return it to a straight running state, thereby improving an accuracy of the heat transfer position.

In an implementation, the second position is a line with a certain width that spans a width of the continuous textile fabric M, and the first position is a corner of a fabric unit formed by an inner edge of the line with a side edge of one width side of the continuous textile fabric M. As shown in FIG. 3, a graticule L extending along the conveying direction of the continuous textile fabric M is provide on the work plane 41, a position of a correction roller of the correction roller assembly 16 is adjusted according to the graticule L to achieve a relative position of the first position in a width direction of the continuous textile fabric M.

In an implementation, as shown in FIG. 3, the work plane 41 includes a metal support surface 41A and a silicone support surface 41B, and the silicone support surface 41B is located below the hot press plate 6.

As shown in FIG. 3, the metal support surface 41A is a part of the rack 100, and there is a notch on one side, which is configured to install the entire heat transfer printing equipment. The entire heat transfer equipment is provided with the silicone support surface 41B. The silicone support surface 41B is flush with the metal support surface 41A to form the work plane 41. The silicone support surface 41B is not only heat-resistant, but also achieves flexibility by adjusting a downward contact between the textile fabric and the hot press plate 6, rendering a contact between the heat transfer paper and the fluff layer M2 closer, thereby improving an effect of heat transfer printing.

Figure 14:
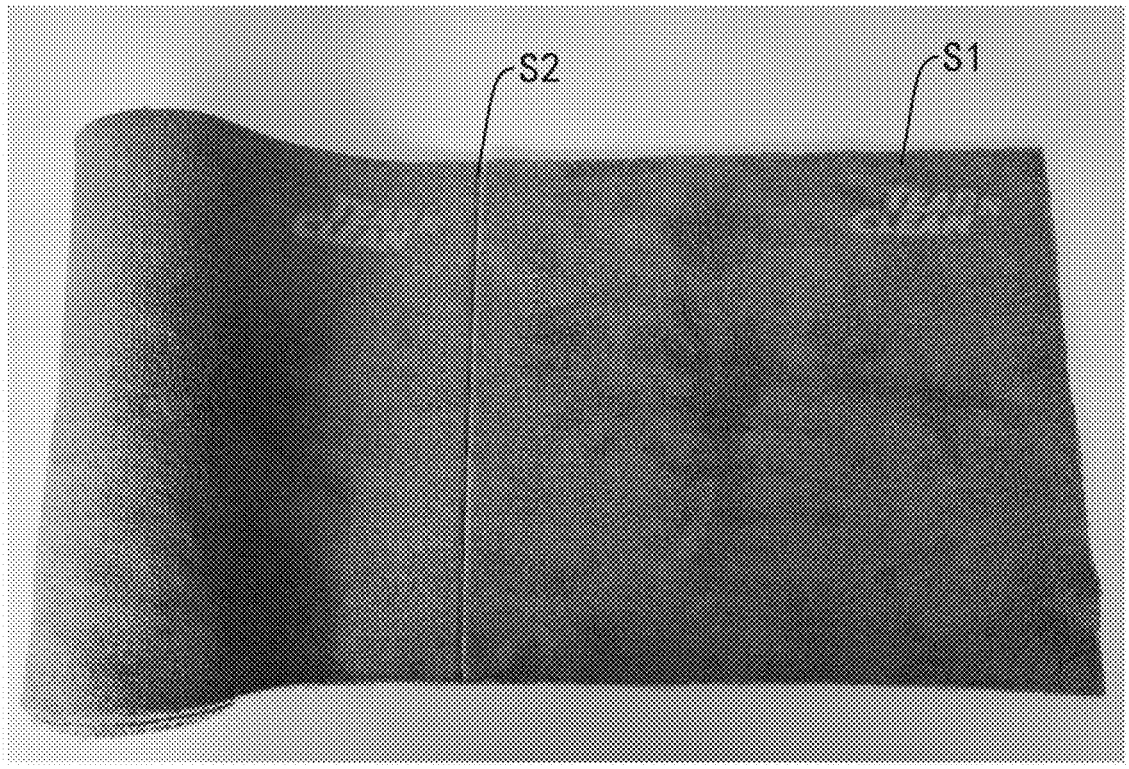
FIG. 14 is a second physical photo of the continuous textile fabric with patterns and hot melt tear lines.

In an example, as shown in FIG. 14, it was unexpectedly discovered that the hot press plate 6 of the heat transfer printing mechanism 300 can be connected to a copper pattern concave-convex template. The hot press plate is configured to connect to the copper pattern concave-convex template so as so as hot press towel cloth to form a concave-convex pattern, a concave part of loops is melted with the base layer of the towel cloth, thereby forming the concave-convex pattern with an un-melted loop. The concave convex template is used to heat press towel cloths with loops or fuzz structures. After heating, the concave convex template will adhere to the towel cloth. In an implementation, the copper pattern concave-convex template is provided with a layer of resistant high-temperature insulation tape, and then the above hot melt mechanism was used to prepare hot melt tear lines with concave convex patterns on the continuous towel cloths to meet the aesthetic needs of different customers for the patterns.

The above introduces the continuous textile fabric, integrated processing equipment, and preparation method provided by the present disclosure. Specific examples are applied in this specification to explain the principles and implementation modes of the present disclosure. The above examples are only used to help understand the present disclosure and core ideas. It should be pointed out that for those skilled in the art, on a premise of not deviating from the principles of the present disclosure, several improvements and modifications can be made to the present disclosure, which also fall within the protection scope of the claims of the present disclosure.

What is claimed is:

1. An integrated processing equipment for continuous textile fabric, comprising:

a feeding fabric mechanism and a receiving fabric mechanism, configured to convey the continuous textile fabric along a length direction and stop at work cycle intervals, and a heat transfer printing mechanism and a hot melt mechanism respectively provided at two positions in a conveying direction of the continuous textile fabric;

the hot melt mechanism comprises a first driving component, a functional component driven by the first driving component, and an ultrasonic welding head with a strip-like plane; the functional component is a metal knife mold or a roller mold with a strip-shaped blade edge;

the heat transfer printing mechanism comprises a transfer worktable, a second driving component, a hot press plate driven by the second driving component, a transfer feeding material component, and a transfer receiving material component;

the transfer feeding material component and the transfer receiving material component are configured to convey and recycle continuous heat transfer paper provided with heat transfer patterns at intervals;

the transfer worktable comprises a work plane configured to lay partial continuous textile fabric, as well as a first limit rod and a second limit rod located above the work plane;

the first limit rod and the second limit rod are parallelly provided on two sides of the work plane along the conveying direction of the continuous textile fabric and have a height gap with the work plane, a heat transfer work area is formed between the first limit rod and the second limit rod;

a first section of the continuous textile fabric passes through the height gap and is laid on the work plane, and a second section of the continuous textile fabric passes along the strip-shaped plane of the ultrasonic welding head; during a pause time of conveying the continuous textile fabric, the first driving component and the second driving component are driven simultaneously to transfer patterns at a first position of the first section of the continuous textile fabric and prepare a hot melt tear line at a second position of the second section;

when the hot press plate rises and the transfer receiving material component pulls the continuous heat transfer paper, the first limit rod and the second limit rod limit an upward displacement of the first section to form a force opposite to a movement of the hot press plate and the continuous heat transfer paper.

2. The integrated processing equipment for continuous textile fabric according to claim 1, wherein:

in a first state, after the hot press plate being driven and pressed by the second driving component, pattern on the continuous heat transfer paper below the hot press plate is transferred to an upper surface of the first section; at the same time, intermittent waves from an ultrasonic generator is received by the ultrasonic welding head, and the functional component is driven by the first driving component to act on the second section so as to prepare the hot melt tear line;

in a second state, the hot press plate moves upwards away from the upper surface of the first section, and the transfer receiving material component recycles the continuous heat transfer paper; the first limit rod and the second limit rod limit an upward displacement of the first section to pull and separate the first section from the hot press plate and the continuous heat transfer paper.

3. The integrated processing equipment for continuous textile fabric according to claim 1, wherein an auxiliary feeding fabric mechanism is provided between the heat transfer printing mechanism and the hot melt mechanism, the auxiliary feeding fabric mechanism comprises a track extending along the conveying direction of the continuous textile fabric and an adaptive adjustment component sliding on the track;

the track is provided with a plurality of track troughs that are parallel, spaced and extending along a length direction; the adaptive adjustment component comprises a sliding body extending along a width direction of the track and a supporting cloth claw body;

the supporting cloth claw body has a plurality of claw parts that match the track troughs, a front side of each claw part is provided with an upward slope from front to back; the sliding body moves along the track, a front end of each claw part extends into a corresponding track trough to adaptively adjust forward and backward movement trajectories of the adaptive adjustment component; the claw parts adaptively lift a local section of the continuous textile fabric that is in a low position due to gravity through the upward slope.

4. The integrated processing equipment for continuous textile fabric according to claim 3, wherein a rear side of the sliding body is provided with a winding cloth roller, and two ends of the winding cloth roller are provided with an annular limit part;

an upper side of the sliding body is provided with a pulling cloth gripper configured for the continuous textile cloth to pass through, and a support surface of a rear end of the supporting cloth claw body is basically flush with a groove bottom of the pulling cloth gripper.

5. The integrated processing equipment for continuous textile fabric according to claim 1, wherein the transfer worktable is provided with a correction roller assembly on two sides of the conveying direction of the continuous textile fabric; each correction roller assembly comprises three correction rollers that freely rotate, the three correction rollers are a first correction roller, a second correction roller, and a third correction roller from back to front; two ends of each correction roller are provided with a limit ring configured to limit a lateral sliding of the textile fabric;

the continuous textile fabric is wound from above the first correction roller to below the second correction roller, and then wound above the third correction roller before being led forward.

6. The integrated processing equipment for continuous textile fabric according to claim 1, wherein the second position is a line with a certain width that spans a width of the continuous textile fabric, and the first position is a corner of a fabric unit formed by an inner edge of the line with a side edge of a width side of the continuous textile fabric;

a graticule extending along the conveying direction of the continuous textile fabric is provided on the work plane.

7. The integrated processing equipment for continuous textile fabric according to claim 6, wherein:

the transfer worktable is provided with a correction roller assembly on two sides of the conveying direction of the continuous textile fabric, and two ends of a correction roller of the correction roller assembly are provided with the limit ring that limit a side edge of the continuous textile fabric;

a position of the correction roller of the correction roller assembly is adjusted according to the graticule to achieve a relative position of the first position in a width direction of the continuous textile fabric.

8. The integrated processing equipment for continuous textile fabric according to claim 1, wherein the work plane comprises a metal support surface and a silicone support surface, and the silicone support surface is located below the hot press plate.

9. The integrated processing equipment for continuous textile fabric according to claim 1, wherein the functional component is a metal knife mold or a roller mold with a strip-shaped blade edge;

the hot press plate of the heat transfer printing mechanism is connected to a copper pattern concave-convex template, and the copper pattern concave-convex template is provided with a layer of resistant high-temperature insulation tape; the hot press plate is configured to connect to the copper pattern concave-convex template so as hot press towel cloth to form a concave-convex pattern.

10. A continuous textile fabric with patterns and hot melt tear lines, comprising a base layer and at least one fluff layer on a surface of one side, wherein the fluff layer is a loop layer or a fuzz layer; and the continuous textile fabric with patterns and hot melt tear lines is prepared through the integrated processing equipment for continuous textile fabric according to claim 1;

the continuous textile fabric is uniformly provided with hot melt tear lines at intervals, the hot melt tear lines run through its width to separate the continuous textile fabric into a plurality of independently separable cloth units;

each fabric unit is provided with a heat transfer pattern at a corner formed by an inner edge of the hot melt tear lines and a side edge of a width side of the continuous textile fabric; and the heat transfer printing pattern is located on one surface of the fluff layer.

11. An integrated procession method for continuous textile fabric, wherein the integrated processing equipment for continuous textile fabric according to claim 1 is used to synchronously prepare patterns and hot melt tear lines on the continuous textile fabric with loops or fuzz on a surface, and the integrated procession method comprises the following steps:

a feeding fabric mechanism and a receiving fabric mechanism being running and pulling forward for a certain length and stopping;

a second driving component driving a hot press plate by a control system command, transferring pattern on continuous heat transfer paper below it to an upper surface of a fluff layer of a first position of a first section of the continuous textile fabric;

when the second driving component being running, a first driving component acting on a functional component; at this time, receiving intermittent waves from an ultrasonic generator by an ultrasonic welding head, and the functional component working together with the ultrasonic welding head on two surfaces of the continuous textile fabric to prepare a hot melt tear line in a second section;

simultaneously rebounding the second driving component and the first driving component;

when a hot press plate being rebounded by the second driving component, recycling the heat transfer paper by a transfer material receiving component; separating a first position of the continuous textile fabric from the heat transfer paper by pulling up and down, previously pressed loops or fuzz by hot transfer is lift up again through a separation force;

when a color code sensor illuminating the pattern, stopping receiving material by a transfer material receiving component;

the feeding fabric mechanism and the receiving fabric mechanism repeating a next pulling operation.

12. A continuous textile fabric with patterns and hot melt tear lines, comprising a base layer and at least one fluff layer on a surface of one side, wherein the fluff layer is a loop layer or a fuzz layer, and the continuous textile fabric with patterns and hot melt tear lines is prepared through the integrated procession method for continuous textile fabric according to claim 11, wherein the continuous textile fabric is uniformly provided with hot melt tear lines at intervals that run through its width to separate the continuous textile fabric into a plurality of independently separable fabric units;

each fabric unit is provided with a heat transfer pattern at a corner formed by an inner edge of the hot melt tear lines and a side edge of a width side of the continuous textile fabric, and the heat transfer pattern is located on one surface of the fluff layer.

13. A continuous textile fabric with patterns and hot melt tear lines, comprising a base layer and at least one fluff layer on a surface of one side, wherein the fluff layer is a loop layer or a fuzz layer, the continuous textile fabric with patterns and hot melt tear lines is prepared through the integrated procession method for continuous textile fabric according to claim 11, wherein the continuous textile fabric is uniformly provided hot melt tear lines at intervals that run through its width to separate the continuous textile fabric into a plurality of independently separable fabric units;

each fabric unit is provided with a hot melt body and a concave convex pattern formed with a loop layer at a corner formed by an inner edge of the hot melt tear lines and a side edge of a width side of the continuous textile fabric, and the concave convex pattern is provided on one surface of the fluff layer.

* * * * *